United States Patent [19]

Braverman et al.

[11] Patent Number: 4,673,086

[45] **Date of Patent: * Jun. 16, 1987**

[54] MOISTURE IMPERVIOUS MEANS FOR UNIT DOSE PACKAGING

[75] Inventors: Milton Braverman, 640 Wynmill Pl., Philadelphia, Pa. 19115; Leonard Zink, Philadelphia, Pa.

[73] Assignee: Milton Braverman, Philadelphia, Pa.

[ * ] Notice: The portion of the term of this patent subsequent to Feb. 23, 1999 has been disclaimed.

[21] Appl. No.: 666,450

[22] PCT Filed: Mar. 19, 1981

[86] PCT No.: PCT/US81/00343

§ 371 Date: Mar. 19, 1981

§ 102(e) Date: Mar. 19, 1981

[87] PCT Pub. No.: WO81/02875

PCT Pub. Date: Oct. 15, 1981

[51] Int. Cl.[4] ..... B65D 83/04; B65D 85/56

[52] U.S. Cl. ..... 206/538; 206/534; 206/820

[58] Field of Search ..... 206/538, 534.1, 534, 206/459, 232, 820, 532

[56] References Cited

U.S. PATENT DOCUMENTS

| | | | |
|---|---|---|---|
| 3,049,224 | 8/1962 | Fredette et al. | 206/532 |
| 3,305,077 | 2/1967 | Greif et al. | 206/232 |
| 3,503,493 | 3/1970 | Nagy | 206/232 |
| 3,715,856 | 2/1973 | Borel | 206/459 |
| 3,924,748 | 12/1975 | Braverman | 206/534.1 |
| 4,316,541 | 2/1982 | Braverman et al. | 206/820 |

*Primary Examiner*—William Price
*Assistant Examiner*—Jimmy G. Foster
*Attorney, Agent, or Firm*—Caesar, Rivise, Bernstein, Cohen & Pokotilow, Ltd.

[57] ABSTRACT

Barrier sheets for securement to the cover sheet of a multi-compartment medicinal dispensing device having a multi-chambered base to make the device impervious to moisture. The cover sheet includes plural closures releasably secured to one another along weakened lines. The barrier sheet is formed of a moisture impervious plastic and has a central portion and edge portions each including an adhesive on its underside surface. The central portion includes plural weakened lines corresponding to the weakened lines in the closures of the device. In one embodiment, each of the edge portions are narrow elongated flaps. The barrier sheet is secured to the cover sheet by disposing it on the cover sheet with the flaps folded around the edges of the cover sheet and into securement with the device base to seal the edges of the cover sheet. In another embodiment, the central portion of the barrier sheet includes an array of openings to receive the compartments of the base and the flaps are arranged to fold over and completely cover the cover sheet. In another embodiment, a primary moisture impervious cover sheet is provided. The primary cover sheet includes a foil layer on the underside of a paper layer. The underside of the foil layer includes a pressure sensitive adhesive for securing the cover sheet to the base of the medicinal dispensing device. The cover sheet includes intersecting weakened lines to define plural closures.

23 Claims, 18 Drawing Figures

MOISTURE IMPERVIOUS MEANS FOR UNIT DOSE PACKAGING

BACKGROUND OF INVENTION

Various multi-compartment medicinal dispensing devices are commercially available for providing multiple unit doses of medication. For example, in U.S. Pat. No. 3,780,856, whose disclosure is incorporated by reference herein, there is disclosed and claimed a multi-compartment medicinal dispensing device which is arranged for holding plural doses of medicine therein for subsequent dispensation. The device is arranged to be simply loaded and labeled by hospital or other personnel.

Unlike prior art devices, the device of said patent is arranged for manual unit dose use. To that end, that dispensing device comprises a base and a cover sheet. The base comprises a plurality of individual medicine holding units, each having flanges thereon. The flanges have corners and are detachably connected along predetermined weakened lines so that the flange of one unit can be separated from the flange of an adjacent unit to separate the units from one another. Each unit also includes a chamber with an outer opening depending from the flanges forming the unit. The chamber is adapted to hold the drug, tablet, capsule or the like therein. The base is formed of plastic or any other suitable material. A cover sheet, formed of paper, cardboard and the like is arranged to seal the medicines within the individual units. The cover sheet has a removable liner sheet releasably secured thereto. The cover sheet includes an underside surface having an adhesive thereon and is perforated along predetermined lines corresponding to the flange lines to form a plurality of individual closures therebetween. Each of the closures corresponds to an individual unit of the base and is arranged to seal the opening of the chamber in the unit which is disposed thereunder. Areas of the cover sheet which are disposed immediately over the chamber openings of the base are non-tacky. At least one corner of the flange of each unit is cut away so that the existing corner of the individual closure overlying the cut away area functions as a lift tab to facilitate the separation of the closure from the flange to which it is connected, to thereby provide access to the contents of the chamber disposed thereunder.

In one embodiment of the invention disclosed in said patent, the article-holding units are provided in an array of five rows of five columns, i.e., five units per row.

As mentioned above, the cover sheet is formed of paper or other suitable material and includes a top surface which is suitable for carrying indicia thereon, e.g., information about the prescription, etc.

While the medicinal dispensing device of the aforenoted patent is suitable for its intended purposes, it may not provide sufficient protection for moisture sensitive drugs stored in humid or wet conditions for an extended period of time.

SUMMARY OF THE INVENTION

Accordingly, it is the general object of the instant invention to provide means for rendering prior art multi-compartment medicinal dispensing devices, like that disclosed and claimed in the aforenoted patent, impervious to moisture.

It is a further object of the instant invention to provide a barrier sheet which is simple in construction and low in cost and which can be used to seal the cover sheet of a multi-compartment medicinal dispensing device against the ingress of moisture.

It is still a further object of the instant invention to provide a moisture impervious barrier sheet for use with multi-compartment medicinal dispensing devices and which does not impede the separation of individual compartments from one another.

It is still a further object of the instant invention to provide a moisture impervious barrier sheet for multi-compartment medicinal dispensing devices which can be readily secured to such devices.

These and other objects of a first aspect of the instant invention are achieved by providing a moisture impervious barrier sheet for use on a multi-compartment medicinal dispensing device having a base including an array of plural chambers releasably secured to one another along weakened flange lines and a paper cover sheet secured to said base, said cover sheet including plural closures releasably secured to one another along weakened lines corresponding to the weakened lines of said base.

In a first embodiment of the first aspect of the instant invention, the barrier sheet is formed of a mositure impervious plastic and comprises a central portion, a top edge portion, a bottom edge portion and an opposed pair of side edge portions. Each of the portions includes an inner surface having an adhesive thereon. Each of said edge portions is in the form of an elongated foldable flap. The central portion corresponds in size with the cover sheet of the medicinal dispensing device and includes weakened lines corresponding to the weakened lines of the cover sheet. The barrier sheet is securable to the cover sheet by disposing it on the cover sheet so that its adhesive contacts the cover sheet with its weakened lines coincident with the weakened lines of the cover sheet and with its flaps folded around the edges of the cover sheet and into securement with the multi-compartment base.

In a second embodiment of the first aspect of the instant invention, the barrier sheet is formed of a moisture impervious plastic and comprises a central portion, a top flap portion, a bottom flap portion, and a pair of opposed side flap portions. The central portion of the flap portions each include an inner surface having an adhesive thereon. The central portion corresponds in size with the cover sheet and includes an array of openings, each opening being arranged to receive a respective chamber of said base, and plural weakened lines corresponding to the weakened lines of said base. Each flap also includes plural weakened lines. The barrier sheet is securable to the device by disposing its central portion under the base of the device so that its adhesive contacts the base and with the base's chambers extending through the openings so that the weakened lines of the central portion coincide with the weakened lines of the base. Each flap is folded over the edge of the base and into engagement with the top of the cover sheet so that the adhesive on the barrier sheet flap adheres to the cover sheet and with the weakened lines of the flap coincident with the weakened lines of the cover sheet. The flaps are of sufficient size that when all are folded over and secured to the cover sheet, the entire surface of the cover sheet is covered by the barrier sheet's flaps.

While barrier sheets of the first aspect of this invention are suitable for making an assembled, paper covered, multi-compartment medicinal dispensing device impervious to moisture, the need exists for a primary cover sheet to form a multi-compartment medicinal dispensing device directly and which is moisture impervious, without using a separate, moisture impervious barrier sheet.

Accordingly, it is a further object of the instant invention to provide a cover sheet for a multi-compartment medicinal dispensing device which is impervious to moisture.

It is a further object of this invention to provide a primary cover sheet for a multi-compartment medicinal dispensing device which is impervious to water and which allows ready separation of the compartments making up said device.

It is still a further object of this invention to provide a foil-backed cover sheet for a multi-compartment medicinal dispensing device.

It is yet a further object of the instant invention to provide a paper-covered, foil-backed cover sheet for a multi-compartment medicinal dispensing device.

These and other objects of a second aspect of the instant invention are achieved by providing a primary moisture impervious cover sheet for securement to a multi-compartment medicinal dispensing device base having an array of plural, medicine-receiving, flanged chambers, releasably secured to one another along weakened lines in the flanges thereof. The cover sheet comprises a first layer, formed of paper disposed on a second layer formed of foil. The second layer has an undersurface upon which a pressure-sensitive adhesive layer is disposed. The adhesive layer is covered by a releasably securable liner sheet. The cover sheet includes a plurality of weakened lines extending therethrough and which lines correspond to the weakened lines of the flanges of the base to form a plurality of closures, one for each chamber of the base. The cover sheet is securable to the base by removing the liner sheet and placing the cover sheet with the exposed adhesive on the flanges of the base and with the weakened lines of the cover sheet coincident with the corresponding weakened lines of the flanges of the base.

Other objects and many of the attendant advantages of this invention will become readily apparent by reference to the accompanying drawing wherein:

Figure 1:
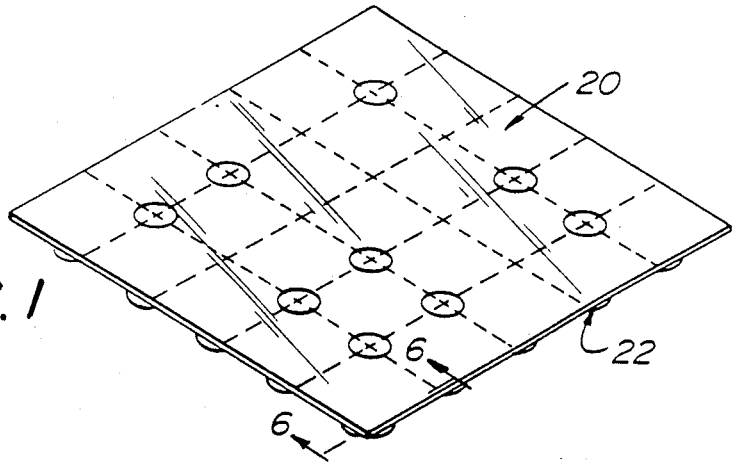
FIG. 1 is a plan view of a multi-compartment medicinal dispensing device, like that shown and claimed in U.S. Pat. No. 3,780,856, and to which a first embodiment of moisture impervious barrier sheet in accordance with a first aspect of the instant invention is secured.
Figure 2:
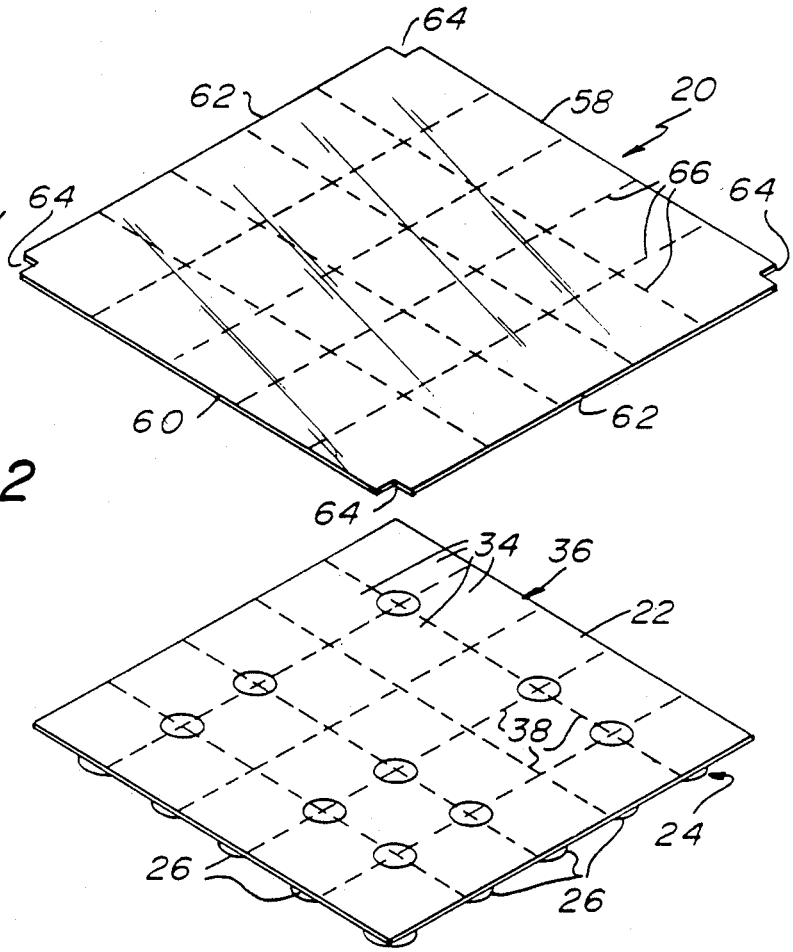
FIG. 2 is an exploded perspective view of the moisture impervious barrier sheet of the instant invention shown disposed over a medicinal dispensing device prior to securement thereto.

Referring now in greater detail to the various figures of the drawing wherein like reference characters refer to like parts, there is shown at 20 in FIG. 2 a moisture impervious barrier sheet for securement to a multi-compartment medicinal dispensing device 22, like that disclosed and claimed in the aforenoted U.S. Pat. No. 3,780,856.

Figure 17:
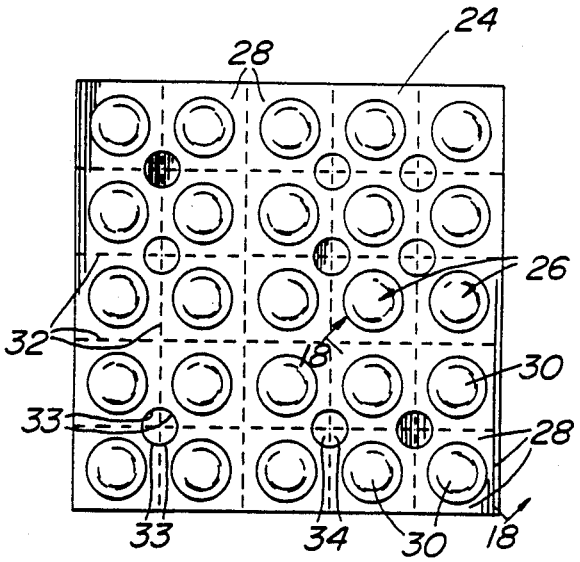
FIG. 17 is a plan view of the underside of a completed multi-compartment medicinal dispensing device using the primary moisture impervious cover sheet of FIG. 14.

Before describing the details of the barrier sheet, a brief review of the construction of the dispensing device 22 is in order. To that end, the device 22 includes a multi-compartment base member 24 (FIGS. 1, 6, 12, 17 and 18) for holding a plurality of doses of medicine 316 (FIG. 17) therein. The base 24 includes a plurality of article-holding units 26 (FIG. 17), each of which is of generally rectangular shape and comprises four flanges 28 of having corners and a chamber 30 depending from the flanges. The chamber is bowl shaped and includes an opening through which the medicine is inserted for disposition within the chamber. The units 26 are detachably connected together by their flanges along intersection weakened or perforated lines 32. Each unit has one flange having a cut-away corner 33 (FIG. 17).

Figure 6:
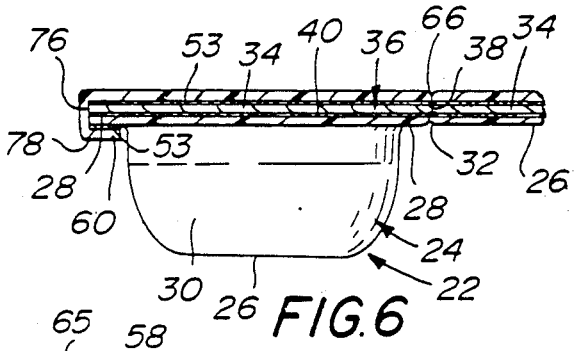
FIG. 6 is an enlarged sectional view taken along line 6—6 of FIG. 1.
Figure 7:
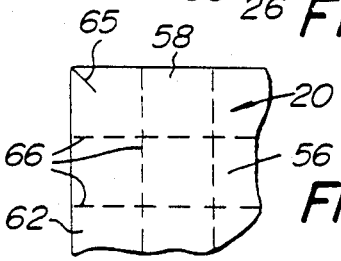
FIG. 7 is a partial plan view of the top surface of an alternative embodiment of the barrier sheet of the instant invention.

The contents in the chamber of each unit is sealed therein by a respective closure 34 (FIGS. 2, 6 and 7). Each closure 34 is a portion of a cover sheet 36. The cover sheet 36 is preferably formed of strong and sturdy paper base. Preferably, the exterior surface of the cover sheet is coated to be receptive to pencil, ink, multilith spirit masters and photocopy offset so that writing or other indicia can be placed upon the exterior surface of the closures. The cover sheet is perforated along intersecting lines 38 which correspond to the flange lines 32 of the base 24. The intersecting lines 38 define five rows of five columns of closures 34 therebetween, with each closure being co-extensive in size with an associated article-holding unit 26.

The cover sheet 36 includes an adhesive layer 40 on its underside for securement to the flanges 28 of the base 24. When the cover sheet 36 is secured in place, its perforated lines 38 overly and are co-linear with the flange lines 32 so that each closure member 34 is secured in place to an associated unit 26 to seal the opening of the chamber in the unit. The coincident perforated lines 38 and flange lines 32 enable each unit 26 to be detached from the others to provide individual, sealed, doses of medicine.

When it is desired to remove the contents of any unit 26, the closure 34 sealing that unit is peeled off at the cut away flange corner to provide access to the interior of the chamber and to the medicine disposed therein.

The moisture impervious barrier sheet 20 of the first aspect of the instant invention is arranged for securement to the device 22 or similarly constructed devices to prevent moisture from gaining ingress to the interior of the chambers 30, via the closures 34, or the adhesive interface 40 between the closures and the base 24.

Figure 3:
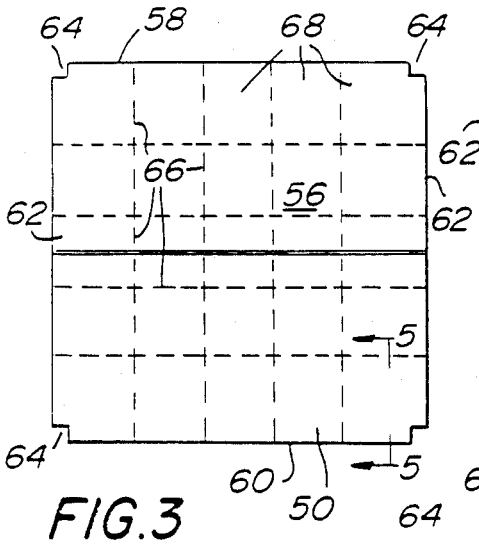
FIG. 3 is a reduced plan view of the top surface of the barrier sheet of the instant invention.
Figure 4:
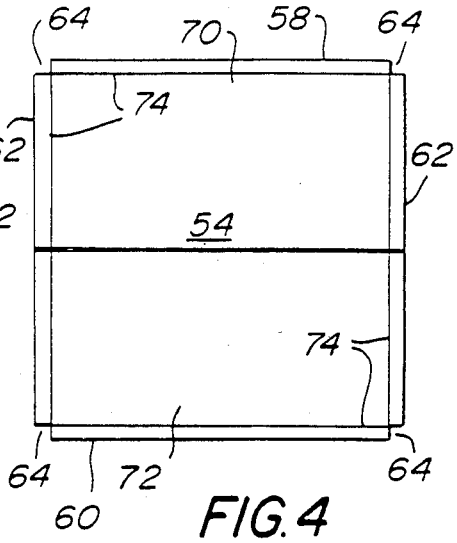
FIG. 4 is a reduced plan view of the underside surface of the barrier sheet.
Figure 5:
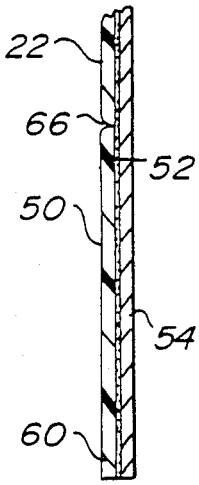
FIG. 5 is an enlarged sectional view taken along line 5—5 of FIG. 3.

Referring now to FIGS. 3, 4 and 5, it can be seen that the first embodiment 20 of the barrier sheet in accordance with a first aspect of this invention basically comprises a planar sheet of a moisture impervious, preferably plastic, material, e.g., polyethylene terephthalate, which is a polymeric plastic sold under the brand name Mylar, having an outer surface 50 and an inner surface 52. An adhesive layer 53 is disposed on the inner surface 52. A relatively non-sticky, e.g., glassine, liner sheet 54 is releasably secured to the adhesive layer 53 of the barrier sheet 20. The liner sheet 54 is of corresponding size and shape to the barrier sheet 20 and serves to protect the adhesive thereon until the barrier sheet is ready for securement to a multi-compartment medicinal dispensing device 22.

Referring now to FIGS. 2, 3 and 4, it can be seen that the barrier sheet 20 is of generally square shape having a central portion 56, a top edge portion 58, a bottom edge portion 60 and an opposed pair of side edge portions 62. Each of the edge portions is in the form of an elongated foldable flap. The foldable flaps are formed in the embodiment of FIGS. 1–6 by notches in the corners at which the edges meet. To that end, a right angle notch 64 is located at the intersection of top edge 54 and side edge 62. A similar notch 64 is located at the intersection of top edge 58 and the other side edge 62. A similar notch 64 is located at the intersection of the bottom edge 60 and one side edge 62 and a similar notch 64 is located at the intersection of the bottom edge 60 and the other side edge 62. The depth of the notches 64 is such that the width and height of the central portion 56 formed between adjacent notches is equal to the width and height, respectively, of the multi-compartment medicinal dispensing device to which it is to be secured. In a second embodiment of the first aspect of this invention, shown in FIG. 7, the flaps are formed by diagonally extending slits 65 whose length is such that the central portion 56 is also equal to the width and height of the dispensing device.

A plurality of weakened lines 66 are provided in the barrier sheet. The weakened lines 66 are formed by a series of tightly packed perforations extending through the thickness of the barrier sheet 22 (See FIG. 5). The perforated lines 66 are disposed in two groups. One group of perforations extends from the top edge 58 to the bottom edge 60 and another group of perforations 66 extends from one side edge 62 to the other edge 62 so that the perforated lines intersect one another at right angles. The intersecting perforated lines form a plurality of barrier sections 68. The size and shape of the closures 34 of the cover sheet of the multi-compartment medicinal dispensing device 22.

In FIG. 4 there is shown the underside of the barrier sheet 20 embodiments of FIGS. 1–6. As can be seen therein, the liner sheet 54 is composed of two sections, namely, upper section 70 and lower section 72.

As can be seen in FIG. 4, the upper section 70 of the liner sheet includes indicia or lines 74 thereon. The lines 74 define the perimeter of the central portion 56 of the barrier sheet and define the location at which the multi-compartment medicinal dispensing device 22 is to be secured to the barrier sheet. The lines 74 also define fold lines for the foldable edges 58, 60 and 62.

It must be noted at this juncture that while only the upper section 70 is shown as including lines 74, the lower section 72 may also include such lines, if desired. Moreover, the liner sheet of the embodiment shown in FIG. 7 is constructed similarly to the embodiment of FIGS. 1–6 and includes lines 74 thereon.

The securement of the barrier sheet 20 to an assembled multi-compartment medicinal dispensing device 22 is as follows:

The lower section 72 of the barrier sheet lining 54 is removed from the barrier sheet to expose the adhesive 52 on the underside of the barrier sheet. The barrier sheet is then placed on a suitable support with the adhesive side up and an assembled multi-compartment medicinal dispensing device 22 is placed face down against the exposed adhesive of the barrier sheet and within the boundary defined by the lines 74. Pressure is lightly applied to the base 24 of the device 22 to force its cover sheet 36 into engagement with the exposed adhesive 52 on the cover sheet. This secures one half of the barrier sheet to the device's cover sheet. The device 22 with the partially secured barrier sheet is then turned over and the upper section 70 of the liner sheet 54 is removed to expose the adhesive on the upper portion of the barrier sheet. The barrier sheet is then pressed into place to secure it over the entire upper surface of the liner sheet 36. In order to seal the peripheral edges 76 (FIG. 6) of the cover sheet and the interface between the flanges 28 and the cover sheet contiguous with the edges 76, the foldable flaps 58, 60 and 62 are folded around the peripheral edge of the device 22 and into engagement with the underside surface 78 of the peripheral flange 28 of the device's base member 24.

When the barrier sheet 20 is secured to the device as described immediately above, its intersecting weakened or perforated lines 66 coincide with the weakened lines 38 and 32 of the device 22. This feature enables the individual units 26 to be readily separated from one another so that the device 22 maintains its full functional capabilities.

Figure 8:
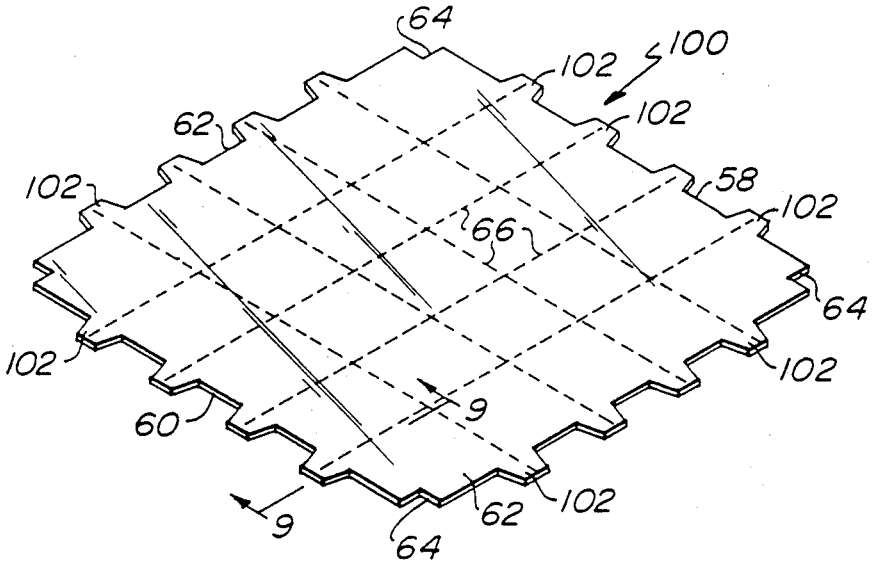
FIG. 8 is a perspective view of a second embodiment of the barrier sheet in accordance with the first aspect of the instant invention.

Referring now to FIG. 8 a third embodiment of the first aspect of this invention is shown generally by the reference numeral 100. The barrier sheet 100 is arranged to provide a greater degree of securement of the barrier sheet flap to the base of the multi-compartment dispensing device 22 than the embodiments 20 shown and described with reference to FIGS. 1–7.

The barrier sheet 100 is constructed in an identical manner to the barrier sheet 20 except for the addition of plural projecting tabs 102. The tabs 102 project outward from the edge of the flaps 58, 60 and 62. Each tab 102 is located on its associated flap at the location of the perforated or weakened lines 66 and such lines extend to the free edge of the tab. Each tab is of a generally truncated triangular shape, with the maximum width being slightly less than the spacing between immediately adjacent chambers 26 of the base of the device 22. The underside 52 of the entire barrier sheet 100 includes the heretofore described adhesive layer 53. A liner sheet 54, which corresponds in shape to the barrier sheet, is releasably secured to the adhesive layer as described with reference to barrier sheet 20.

Figure 9:
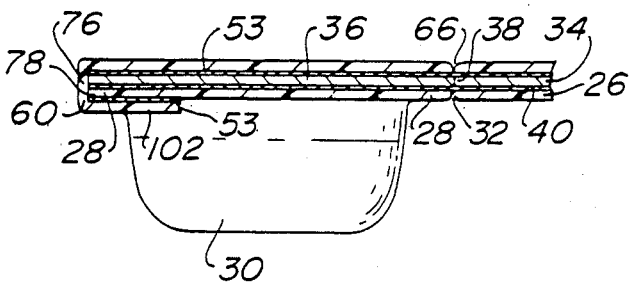
FIG. 9, is an enlarged sectional view similar to that of FIG. 6 taken along the position of line 9—9 of FIG. 8, but after the embodiment shown in FIG. 8 has been secured to a medicinal dispensing device.

The tabs 102 provide additional securement to the base 24 of the multi-compartment device 22 beyond that which is provided by the somewhat narrow flaps 58, 60 and 62 of the barrier sheet 20. To that end, as can be seen by comparing FIGS. 6 and 9, when the flaps 58, 60 and 62 are bent around the peripheral edge of the device 22 and into engagement with the underside surface 78, each of the tabs 102 extends beyond the peripheral flange of the device 22 and into the space between adjacent chambers and into engagement with the base flange portion thereat. Such action provides additional adhesive holding power for the flap.

Like the barrier sheet 20, the barrier sheet 100 may include notches 64 in its corners, angularly extending slits 65 or any other means enabling the contiguous flaps to be bent independently of each other into engagement with the base of the device 22.

In FIGS. 10–13 there is shown a fourth embodiment of a barrier sheet 200 in accordance with the first aspect of this invention. The barrier sheet 200, like the barrier sheets 20 and 100 described heretofore, is used on an assembled, papercover, multi-compartment medicinal dispensing device 22 to make it impervious to moisture. However, unlike the barrier sheets 20 and 100 in which the central portion of the barrier sheet is secured to the device's cover sheet 36, with the flaps secured to the device's base 24, the barrier sheet 200 is arranged so that its central portion (to be described later) is adhesively secured to the device's base, with its flap portions (to be described later) being folded over and secured to the cover sheet, to completely cover the cover sheet. This feature insures that the flaps do not lift off the device, thereby exposing the edges of the cover sheet, which action would have the effect of enabling the ingress of moisture through the edge of the cover sheet and through the interface between the cover sheet and the flange of the base to which the cover sheet is secured.

The barrier sheet 200 basically comprises a planar sheet of a moisture impervious, preferably plastic material (like the barrier sheets 20 and 100) and having an outer surface 202 and an inner surface 204. An adhesive layer 206 is disposed on the inner surface 204. A relatively non-sticky, e.g., glassine, liner sheet 208 is releasably secured to the adhesive layer 206 of the barrier sheet 200. The liner sheet is formed of a plurality of sections, to be described in detail later, and corresponds to the size and shape to the barrier sheet 200 to protect the adhesive on the barrier sheet until the barrier sheet is ready for securement to a multi-compartment medicinal dispensing device base 24.

Figure 12:
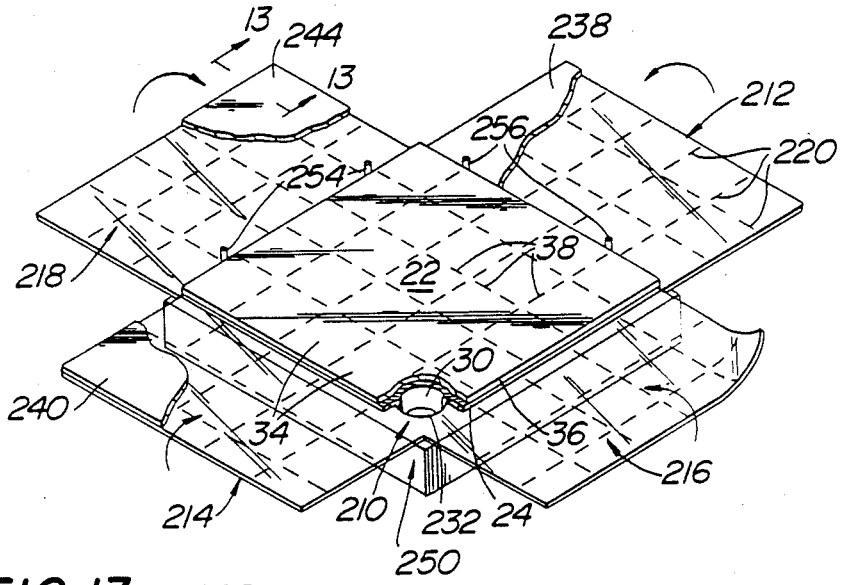
FIG. 12 is an enlarged perspective view of the barrier sheet of FIG. 10 in the process of securement to a multi-compartment medicinal dispensing device like that shown in U.S. Pat. No. 3,780,856.
Figure 13:
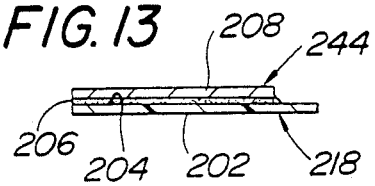
FIG. 13 is a sectional view taken along line 11—11 of FIG. 10.
Figure 11:
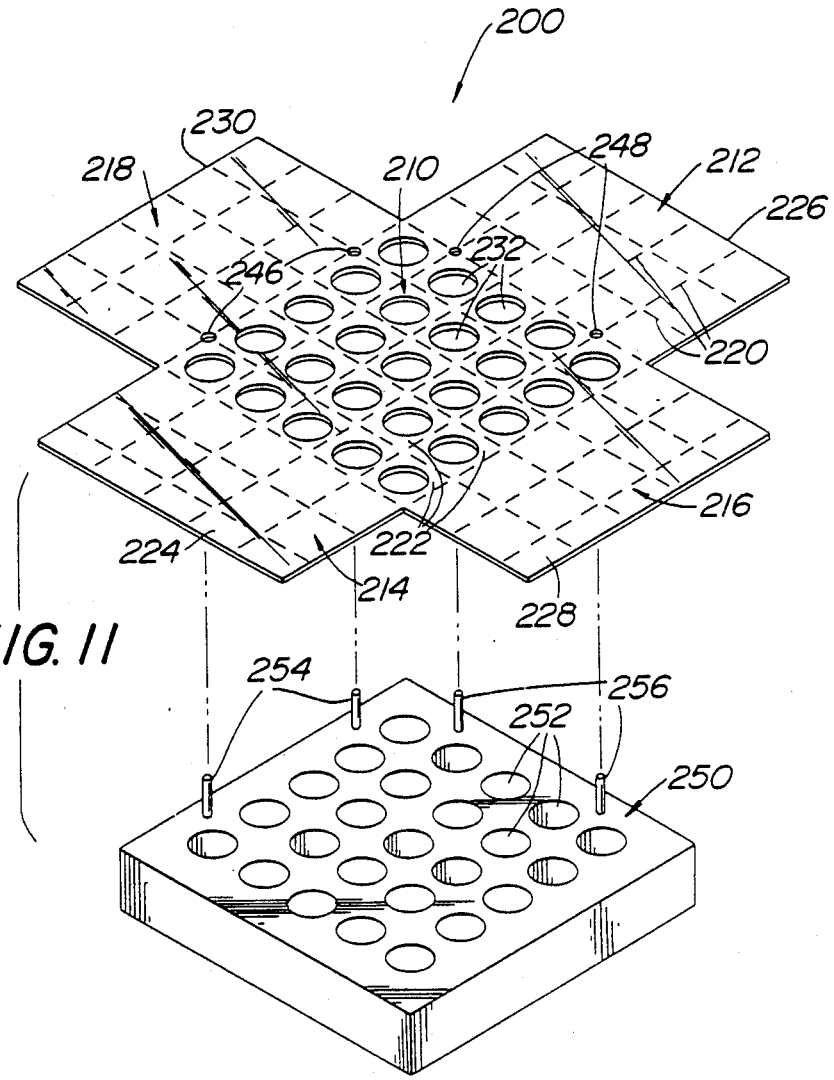
FIG. 11 is an enlarged perspective view of an embodiment of the moisture impervious barrier sheet of FIG. 10 but without the liner sheet and shown disposed over a fixture base like that shown in U.S. Pat. No. 3,780,856.

As can be seen in FIGS. 11 and 12, the barrier sheet 200 is of generally cross-shape, having a central portion 210, a top flap portion 212, a bottom flap portion 214, side flap portion 216 and a side flap portion 218. The central portion 210 of the barrier sheet 200 is coextensive in size with the cover sheet 36 of the device 22 to which it is to be secured. A plurality of weakened lines 220 are provided in the barrier sheet. Each weakened line 220 is formed by a series of tightly packed perforations extending through the thickness of the barrier sheet. In some applications, each weakened line may consist of a pair of closely spaced parallel lines of tightly packed perforations. The weakened lines 220 are disposed in two groups which intersect at right angles to each other, with one group extending parallel to the edges of the top and bottom flaps and with another group extending parallel to the edges of the side flaps. The intersecting perforated lines form a plurality of barrier sections 222 (FIG. 11). The size and shape of the barrier sections correspond to the size and shape of the closures 34 (FIG. 12) of the cover sheet 36 of the multi-compartment medical dispensing device 22.

Each of the flaps 212-218 is arranged to be folded over its associated edge of the device 22 and into adhesive engagement on the cover sheet to completely cover and seal the cover sheet. Since in the embodiment shown, the multi-compartment medicinal dispensing device includes five rows of five columns of compartments, the opposed flaps 212 and 214 together define five rows and five columns of barrier sections 222 when they are folded over. In a similar manner, the opposed flaps 216 and 218 define five rows of five columns of barrier sections 222 when those flaps are folded over. To that end, in the embodiment shown in FIG. 10, flap 214 includes two and a half rows of five columns in FIG. 10, flap 214 includes two and a half rows of five columns of barrier sections 222 formed by intersecting weakened lines 220, while the opposed flap 212 includes three rows of five columns of barrier sections 222 also formed by the intersecting weakened lines 220. The half row of flap 214, which half row is defined generally by the reference numeral 224, laps the edge 226 of the opposed flap 212 when the flaps are secured to the cover sheet to insure that there is no gap between the flap edges. In a similar manner, the side flap 216 includes two and one half columns of five rows of barrier sections 222, while its opposed flap 218 includes three columns of five rows of barrier sections. The half column 228 of flap 216 laps the edge 230 of the flap 218 when those flaps are secured to the cover sheet to insure that there is no gap between the flap edges.

The central portion 210 of the barrier sheet includes an array of plural openings 232 (FIG. 11). To that end, each barrier section 222 includes an opening 232 disposed centrally therein so that the openings correspond to the position of the chambers 30 (FIG. 12) of the device base 24. Moreover, each opening 232 is of sufficient diameter to enable the device's chamber 30 to extend therethrough when the barrier sheet is secured in place on the device, as will be described later.

Figure 10:
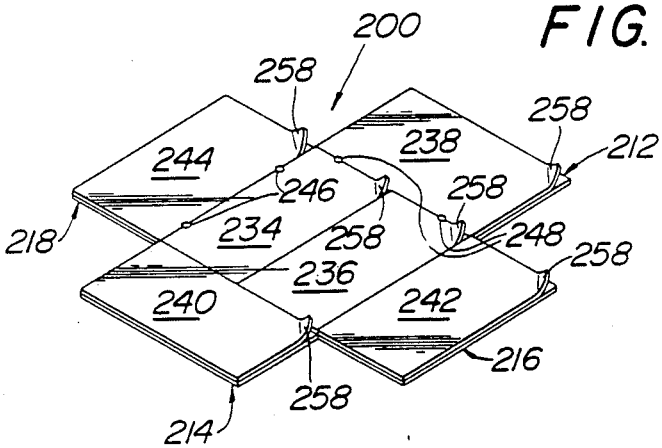
FIG. 10 is a perspective view of the underside of a third embodiment of a moisture impervious barrier sheet in accordance with the first aspect of the instant invention.

As can be seen in FIG. 10, the liner sheet 208 includes six sections, namely, central sections 234 and 236, top section 238, bottom section 240 and side sections 242 and 244. The central sections 234 and 236 together cover the full width and height of the central portion 210 of the barrier sheet 200, while section 238 fully covers the upper flap 212, section 240 fully covers the lower flap 214, section 242 fully covers the side flap 216 and section 244 fully covers the side flap 218. The sectioning of the liner sheet 208 enables selective portions of the barrier sheet's adhesive to be exposed individually to expedite the securement of the barrier sheet to the device 22 as will be described in detail hereinafter.

As can be seen in FIG. 11, a first pair of alignment openings 246 are provided in the barrier sheet along the edge of the central portion 210 of the barrier sheet contiguous with side flap 218. In a similar manner, a pair of alignment openings 248 are provided in the barrier sheet along the edge of the central portion contiguous with the top flap 212. The pairs of alignment openings 246 and 248 cooperate with pairs of aligment pins on a fixture base 250, (to be described hereinafter) to insure that the barrier sheet 200 is correctly aligned with the assembled multi-compartment medicinal dispensing device 22 so that the intersecting perforated lines of the barrier sheet coincide with the weakened lines of the device.

The fixture base 250 is constructed in accordance with the teachings of U.S. Pat. No. 3,780,856 and basically comprises a block or plate having an array of plural openings 252 disposed therein. Each opening is arranged to receive a respective one of the chambers 30 of the multi-compartment medicinal dispensing device base 24 during the filling of the device 22 and the sealing thereof. The fixture base 250 also includes two pairs of spring-loaded alignment pins 254 and 256, with the pins 254 lying along the left-most column of openings 252 in the base (as shown in FIG. 10) and with pins 256 lying along the top-most row of the openings 252. Moreover, one pin of pair 254 lies along a line (not shown) which divides the top-most and second row of openings 252 while the other pin of that pair lies along a line (not shown) dividing the bottom-most row of openings from the fourth row. In a similar manner, one of the pins of the pair 256 lies along a line (not shown) dividing the left-most column of openings 252 from the immediately adjacent column, while the other pin of that pair lies along a line (not shown) dividing the right-most column of openings 252 from the immediately adjacent column. The spacing between the alignment apertures 246 in the barrier sheet is the same as the spacing between the aligment pins 254 while the spacing between the aligment pins 256.

The securement of the barrier sheet 200 to the device 22 is as follows: The central sections 232 and 234 of the liner sheet are removed by lifting a corner 258 of the liner section and peeling that section away from the barrier sheet, thereby exposing the adhesive on the entire underside surface of the barrier sheet. The barrier sheet is then placed with the exposed adhesive side upward on the fixture base 250 with the aligment pins 254 located within the alignment openings 246 of the barrier sheet and with the alignment pins 256 located within the aligment openings 248. Accordingly, the array of the base chamber receiving openings 250 in the barrier sheet are centered over the holes 252 in the fixture base 250.

The assembled paper-cover, multi-compartment medicinal dispensing device 22 is then placed over the exposed adhesive of the barrier sheet with the base directed downward as shown in FIG. 12, so that its chambers 30 extend through the openings 250 in the central portion of the barrier sheet. The alignment pins 254 and 256 abut the side and top edges of the device 22 acting as stops to insure that the device is perfectly centered with respect to the barrier sheet. Accordingly, the intersecting perforated lines 220 of the barrier sheet are coincident with the intersecting lines 38 of the device 22.

The liner sheet section 242 of side flap 216 is then removed by lifting a corner 258 and peeling the section away to expose the adhesive on the flap and the flap is then folded over the associated side edge of the device 20 onto the top of the cover sheet 36. Pressure is applied, such as through the use of a platen (not shown), to firmly secure the flap 216 to the cover sheet. The liner sheet section 240 on lower flap 214 is then removed in the same manner as described heretofore, and that flap is folded over the associated bottom edge of the device 22 and into engagement with the cover sheet in a similar manner as described with reference to flap 216. The partially covered device 22 is then removed from the fixture base 249 and rotated 180° so that the edges of the device now covered by the folded flaps of the barrier sheet abut the alignment pins 254 and 256, thus recentering the device and barrier sheet on the fixture base 250. The liner sheet section 238 is then removed from flap 212 in the same manner as described heretofore, and that flap is folded over the associated edge of the device 22 and into engagement with the cover sheet in the same manner, as described heretofore, with reference to flaps 214 and 216. Finally, the liner sheet section 244 is removed from flap 218 in the same manner as described heretofore, and that flap is folded over the associated edge of the device 22 into engagement with the cover sheet in the same manner, as described heretofore, to completely cover the cover sheet and thus to complete the moisture impervious package.

Figure 14:
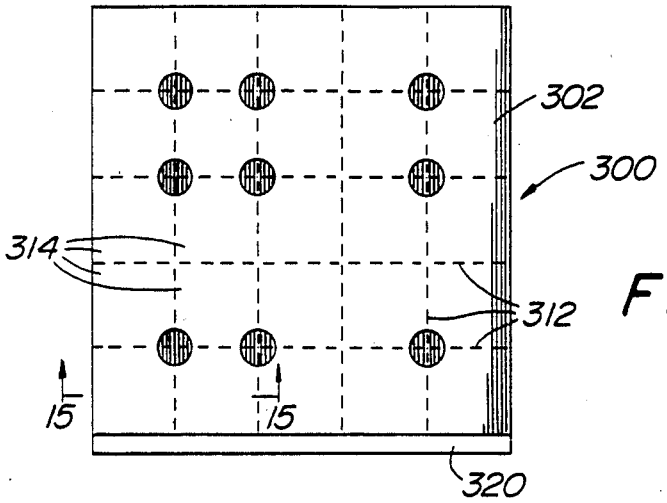
FIG. 14 is a plan view of a primary moisture impervious cover sheet constructed in accordance with a second aspect of this invention.
Figure 15:
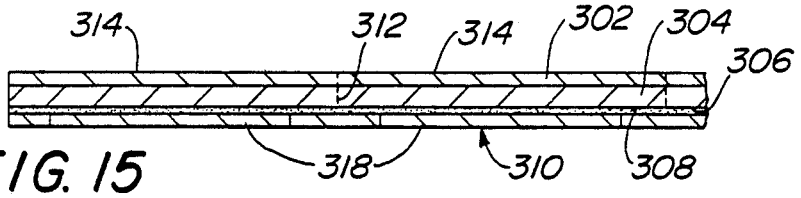
FIG. 15 is an enlarged sectional view taken along line 15—15 of FIG. 14.

In FIG. 14 there is shown a plan view of a primary, moisture impervious cover sheet 300 constructed in accordance with the second aspect of this invention. The cover sheet 300 is arranged to be used in lieu of paper-cover sheet 36 on a medicinal dispensing device base 24 to directly form a moisture impervious multi-compartment medicinal dispensing device without necessitating the use of a separate barrier sheet like those disclosed heretofore. To that end, the cover sheet 300 is a multi-layer construction and basically comprises a top layer 302, formed of paper stock, laminated or coated on a foil underlayer 304. The underside 306 of the foil layer 304 includes a pressure sensitive adhesive, such as an acrylic adhesive, 308 across the full extent of the undersurface. A liner sheet 310, formed of a glassine type material, is releasably secured to the adhesive to cover the adhesive and protect it from exposure until the cover sheet 300 is ready for securement to the mutli-chambered base 24.

In accordance with the preferred embodiment of this invention, the paper layer 302 is formed of a paper stock which is uncoated, yet receptive to pencil, ink, multi-lift spirit masters and photocopy offset to that writing or other indicia can be readily placed upon the exterior surface thereof. The paper layer 302 is relatively thin, e.g., 0.4 mils. The foil, in the preferred embodiment, is Aluminum foil, approximately 0.35 mils thick, but may be other materials.

The cover sheet 300 is perforated along intersecting lines 312 through its paper layer and foil layer, with the intersecting lines corresponding to the flange lines 32 of the medicinal dispensing device base 24. Accordingly, in the embodiment shown, the intersecting perforated line 312 define five rows of five columns of closures 314 therebetween, with each closure being coextensive in size with an associated article-holding unit 26 of the base.

Figure 18:
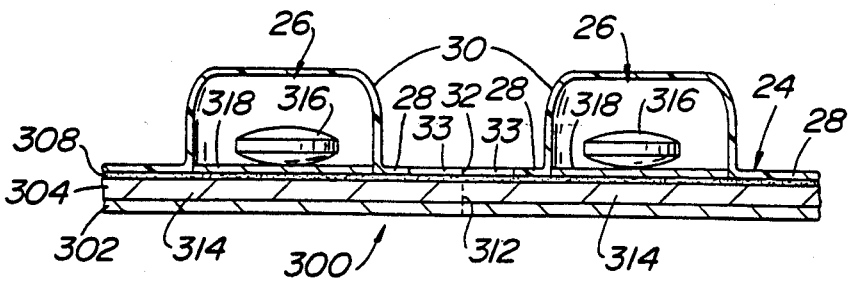
FIG. 18 is an enlarged sectional view taken along line 18—18 of FIG. 17.

The adhesive layer 308 on the bottom of the foil layer is arranged for securement to the flanges 28 of the medicinal dispensing device base 24 in a same manner as the cover sheet 36. When the cover sheet 300 is secured in place, its peforated lines 312 are coincident with the flange lines 32 so that each closure member 314 is secured in place to an associated unit 26, to seal the opening of the chamber 30 in that unit. The coincident perforated lines 31 of the cover sheet and flange lines 32 of the base enable each unit 26 to be detached from the others to provide individual, sealed, doses of medicine 316 (FIG. 18). The foil layer 304 provides an excellent barrier to the ingress of moisture into the sealed chambers of the device, while the exterior paper layer enables indicia to be applied readily to the closures, without the need for sophisticated printing techniques or expensive dyes, etc.

Figure 16:
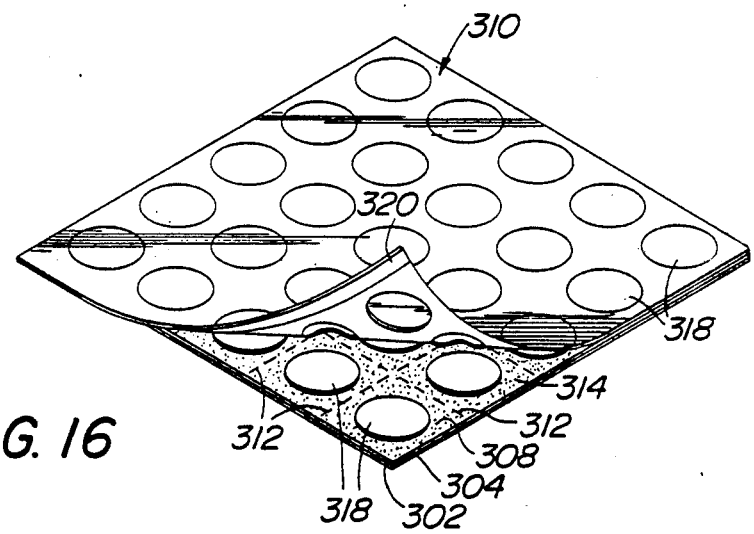
FIG. 16 is a perspective view of the underside of the moisture impervious cover sheet of FIG. 14 shown in the process of removal of its liner sheet.

The liner sheet 310 is arranged to be peeled off the adhesive to expose the adhesive so that the cover sheet 300 can be secured to the flanges of the base 24. The liner sheet also includes an array of die cut circular areas 318 which are centered in the respective closures 314 formed by the intersecting perforated lines 312. One edge of the liner sheet includes a tab 320. The liner sheet is removed from the cover sheet by grasping the tab and peeling of the liner sheet away from the adhesive on the underside of the foil layer, as shown in FIG. 16. This action leaves the circular areas 318 secured to the adhesive on the underside of the foil layer and centered in each closure 314. Accordingly, when the cover sheet 300 is secured in place, the areas 318 are disposed over the chambers of the base, thereby preventing the medicine within each chamber from contacting the adhesive of the cover sheet.

When it is desired to remove the contents of any of the units 26, the closure 314 sealing that unit is peeled off at the cut-away flange corner of the base to provide access to the interior of the chamber and to the medicine 316 disposed therein.

As should be appreciated from the foregoing, the barrier sheets of the instant invention are simple in construction, relatively low in cost and provide a viable means for rendering paper covered, multi-compartment medicinal dispensing devices impervious to the ingress of moisture. The cover sheet of the instant invention is simple in construction, relatively low in cost and provides a viable means for directly forming a moisture impervious multi-compartment medicinal dispensing device without the need for separate barrier sheets.

Without further elaboration, the foregoing will so fully illustrate our invention that others may, by applying current or future knowledge, readily adapt the same for use under various conditions of service.

What is claimed as the invention is:

1. A moisture impervious barrier for use on a multi-compartment medicinal dispensing device having a base to which a cover sheet is secured, said cover sheet including plural closures releasably secured to one another along weakened lines, said barrier comprising a sheet formed of a moisture impervious material and having a central portion, a top edge portion, a bottom edge portion and an opposed pair of side edge portions, said central portion and edge portions each including an inner surface having an adhesive thereon, each of said edge portions being in the form of a elongated foldable flap, said central portion corresponding in size with the cover sheet of said dispensing device and including weakened lines corresponding to the weakened lines of the cover sheet, said barrier sheet being permanently securable to said cover sheet by disposing the barrier sheet on the cover sheet so that said adhesive contacts the cover sheet and with the weakened lines of the barrier sheet being coincident with the weakened lines of the cover sheet and with said flaps being folded around the edges of said cover sheet and into engagement with said base.

2. The barrier sheet of claim 1 wherein said moisture impervious material comprises a plastic.

3. The barrier sheet of claim 2 additionally comprising a liner sheet releasably secured to the plastic barrier sheet by the adhesive on the underside of the barrier sheet.

4. The barrier sheet of claim 3 wherein said weakened lines are perforated.

5. The barrier sheet of claim 4 wherein said top edge meets each of said side edges in a respective notched corner and wherein said bottom edge meets each of said side edges in a respective notched corner.

6. The barrier sheet of claim 5 wherein said weakened lines intersect one another to form an array of five rows of five columns of sections, each section corresponding in size to a respective closure of the cover sheet of said device.

7. The barrier sheet of claim 6 wherein said liner sheet comprises two separable sections.

8. The barrier sheet of claim 7 wherein said plastic comprises polyethylene terephthalate.

9. The barrier sheets of claim 4 wherein said top edge meets each of said side edges in a respective slit corner and wherein said bottom edge meets each of the side edges in a respective slit corner.

10. The barrier sheet of claim 9 wherein said weakened lines intersect one another to form an array of five rows of columns of sections, each section corresponding in size to a respective closure of the cover sheet of said device.

11. The barrier sheet of claim 10 wherein said liner sheet comprises two separable sections.

12. The barrier sheet of claim 11 wherein said plastic comprises polyethylene terephthalate.

13. The barrier sheet of claim 5 additionally comprising plural tab portions projecting outward from each of said flaps for adhesive securement to portions of said base.

14. The barrier sheet of claim 13 wherein said tab portions are located contiguous with said weakened lines and said weakened lines extend to the free edge of said tab portions.

15. The barrier sheet of claim 14 wherein each of said tabs is in the shape of a truncated triangle.

16. A moisture impervious barrier for use on a multi-compartment medicinal dispensing device having a base including a plurality of chambers and to which a cover sheet is secured, said cover sheet including plural closures releasably secured to one another along weakened lines, said barrier comprising a sheet formed of a moisture impervious material and having a central portion, a top flap portion, a bottom flap portion, and a pair of opposed side flap portions, said central portions and flap portions each including an inner surface having an adhesive thereon, said central portion corresponding in size with said cover sheet and including an array of openings for receipt of a respective chamber of said base, said central portion also including a plurality of intersecting weakened lines corresponding to the weakened lines of said base, each of said flaps also including plural intersecting weakened lines, said barrier sheet being permanently secureable to said device by disposing the barrier sheet on the base so that the adhesive contacts the base and with said flaps being folded around the edges of said base and into engagement with the cover sheet to completely cover said cover sheet and with the lines of said flaps being coincident with the weakened lines of the cover sheet.

17. The barrier sheet of claim 16 additionally comprising a liner sheet releasably secured to the barrier sheet by the adhesive on the underside of the barrier sheet.

18. The barrier sheet of claim 17 wherein said weakened line are perforated.

19. The barrier sheet of claim 18 wherein said moisture impervious material comprises a plastic.

20. The barrier sheet of claim 19 wherein said plastic comprises polyethylene terephthalate.

21. The barrier sheet of claim 20 wherein said liner sheet comprises plural sections.

22. The barrier sheet of claim 21 wherein said top flap and said bottom flap form a pair of flaps, with one of said pair of flaps being larger in size than the other and with one of said pair of opposed side flaps being larger than the other of said pair.

23. A moisture impervious barrier for use on a multi-compartment medicinal dispensing device having a base including plural chambers and to which a cover sheet is secured, said cover sheet including plural closures releasably secured to one another along weakened lines, said barrier comprising a sheet formed of a moisture impervious material and having a central portion, a top edge portion, a bottom edge portion and an opposed pair of side edge portions, said central portion and said edge portions each including an inner surface having an adhesive thereon, each of said edge portions being in the form of a foldable flap, said central portion corresponding in size with the cover sheet of said dispensing device and including weakened lines corresponding to the weakened lines of the cover sheet, said barrier sheet being permanently secured to the device and including portions of said barrier sheet completely covering said cover sheet, with the weakened lines of said portion being coincident with the weakened lines of the cover sheet and with portions of the barrier sheet being folded around the edges of the cover sheet and said base.

* * * * *